US005150155A

United States Patent [19]

Rushing

[11] Patent Number: 5,150,155

[45] Date of Patent: Sep. 22, 1992

[54] NORMALIZING AIM VALUES AND DENSITY PATCH READINGS FOR AUTOMATIC SET-UP IN ELECTROSTATOGRAPHIC MACHINES

[75] Inventor: Allen J. Rushing, Webster, N.Y.

[73] Assignee: Eastman Kodak Company, Rochester, N.Y.

[21] Appl. No.: 678,395

[22] Filed: Apr. 1, 1991

[51] Int. Cl.[5] ..... G03G 21/00

[52] U.S. Cl. ..... 355/208; 355/204; 355/246; 355/326

[58] Field of Search ..... 355/208, 245, 246, 203, 355/204, 326, 327; 430/30

[56] References Cited

U.S. PATENT DOCUMENTS

| | | | |
|---|---|---|---|
| 4,179,213 | 12/1979 | Queener | 355/208 |
| 4,183,657 | 1/1980 | Ernst et al. | 355/208 |
| 4,341,461 | 7/1982 | Fantozzi | 355/246 |
| 4,372,672 | 2/1983 | Pries | 355/208 X |
| 4,377,338 | 3/1983 | Ernst | 355/246 |
| 4,466,731 | 8/1984 | Champion et al. | 355/246 |
| 4,647,184 | 3/1987 | Russell et al. | 355/208 |
| 4,693,592 | 9/1987 | Kurpan | 355/208 |
| 4,829,336 | 5/1989 | Champion et al. | 355/246 |
| 4,853,738 | 8/1989 | Rushing | 355/246 X |
| 4,860,059 | 8/1989 | Terashita | 355/38 |
| 4,879,577 | 11/1989 | Mabrouk et al. | 355/208 |
| 4,894,685 | 1/1990 | Shoji | 355/246 |
| 4,951,088 | 8/1990 | Bonvallet et al. | 355/208 X |
| 4,999,673 | 3/1991 | Bares | 355/208 |

FOREIGN PATENT DOCUMENTS

| | | | |
|---|---|---|---|
| 0112450 | 7/1984 | European Pat. Off. | 355/246 |
| 3733925 | 4/1988 | Fed. Rep. of Germany | 355/208 |

*Primary Examiner*—A. T. Grimley
*Assistant Examiner*—Matthew S. Smith
*Attorney, Agent, or Firm*—David A. Howley

[57] ABSTRACT

Test patch densities are accurately determined during automatic set-up procedures, regardless of non-uniformities in the amount of wear and scumming from one part of the image receiver to another, or of variations in the coatings applied to the image receiver during manufacture, by correcting densitometer readings by obtaining density readings on the untoned image receiver during a cycle-up portion of the automatic set-up operation, saving the readings, and subtracting the saved readings from subsequent test readings of the same portion of the image receiver.

6 Claims, 3 Drawing Sheets

NORMALIZING AIM VALUES AND DENSITY PATCH READINGS FOR AUTOMATIC SET-UP IN ELECTROSTATOGRAPHIC MACHINES

BACKGROUND OF THE INVENTION

1. Field of the Invention

The invention relates to electrostatographic document production machines, and more particularly to automatic adjustment of parameters influencing the output reproduction of such machines.

2. Description of the Prior Art

In electrostatographic document production machines such as printers and copiers, image contrast, density, and color balance (in color machines) can be adjusted by changing certain process control parameters such as primary voltage $V_O$, exposure $E_O$, development station electrode bias voltage $V_b$, the concentration of toner in the developer mixture, and the image transfer potential.

Techniques exist for regulating electrostatographic machine process control parameters so as to compensate for long term variations in the electrostatographic process. The phrase "long term" pertains to variations which would affect many successive images, and includes variations caused by such things as changes in toner concentration, wear of the image transfer member, aging of the exposure lamp, and atmospheric conditions.

Prior art systems attempt to diminish the adverse effects of these variations using manual or automatic set-up systems, or a combination of both. In typical manual set-up systems, a skilled operator examines the output reproduction (copy or print) and the corresponding input and output density ($D_{in}$–$D_{out}$) curves for red, green, blue, and black. Based on experience with the equipment, the operator determines adjustments to the process control parameters. Several iterations of adjustment may be required to achieve acceptable color reproductions, in terms of color balance, color fidelity, and tone reproduction.

U.S. Pat. No. 4,894,685 which issued to Shoji on Jan. 16, 1990 discloses a method for setting color process control parameters by forming a plurality of different density patches in a non-transfer portion of a photoconductor. Process control parameters are set in accordance with the differences between the recorded densities and "ideal case" densities referred to herein as "aim" densities. U.S. Pat. No. 4,647,184 which issued to Russell et al on Mar. 3, 1987 relates to a set-up mode wherein test patches of varying density are compared to stored values. The operating process control parameters are adjusted in an iterative process until there is convergence along three separate points of a stored aim curve of the photoconductor's response to exposure.

The condition of the image receiver will affect the density readings. For example, the toned patch density readings may be affected by the amount of wear of the image receiver and the existence of scumming. In the past, attempts have been made to reduce potential errors by the provision of an untoned patch in the general vicinity of the test patch. Density readings from the untoned patch are subtracted from those of the toned patch to compensate for any portion of the test reading not due to the value sought to be determined.

This process has been only partially successful due to non-uniformities in the amount of wear and scumming from one part of the image receiver to another, and further due to variations in the various coatings applied to the image receiver during manufacture. This is especially a problem when the density readings are obtained by transmission densitometers, wherein the density is determined by the amount of light transmitted through a web-type image receiver. See for example commonly-assigned U.S Pat. No. 4,693,592 which issued to V. Kurpan on Sept. 15, 1987.

DISCLOSURE OF INVENTION

It is an object of the present invention to provide for accurately determining test patch densities during automatic set-up procedures, regardless of non-uniformities in the amount of wear and scumming from one part of the image receiver to another, or of variations in the coatings applied to the image receiver during manufacture.

According to one feature of the present invention densitometer readings are corrected by obtaining density readings on the untoned image receiver during a cycle-up portion of the automatic set-up operation, saving the readings, and subtracting the saved readings from subsequent test readings of the same portion of the image receiver. Thus, any non-uniformities from one portion of the image receiver to another do not affect the results.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present invention is described below in the environment of an electrophotographic copier. At the outset, it will be noted that although this invention is suitable for use with such machines, it also can be used with other types of electrostatographic copiers or printers.

For a detailed explanation of the theory of copier contrast and exposure control by changing various process control parameters, reference may be made to the following article: Paxton, Electrophotographic Systems Solid Area Response Model, 22 Photographic Science and Engineering 150 (May/June 1978).

Figure 1:
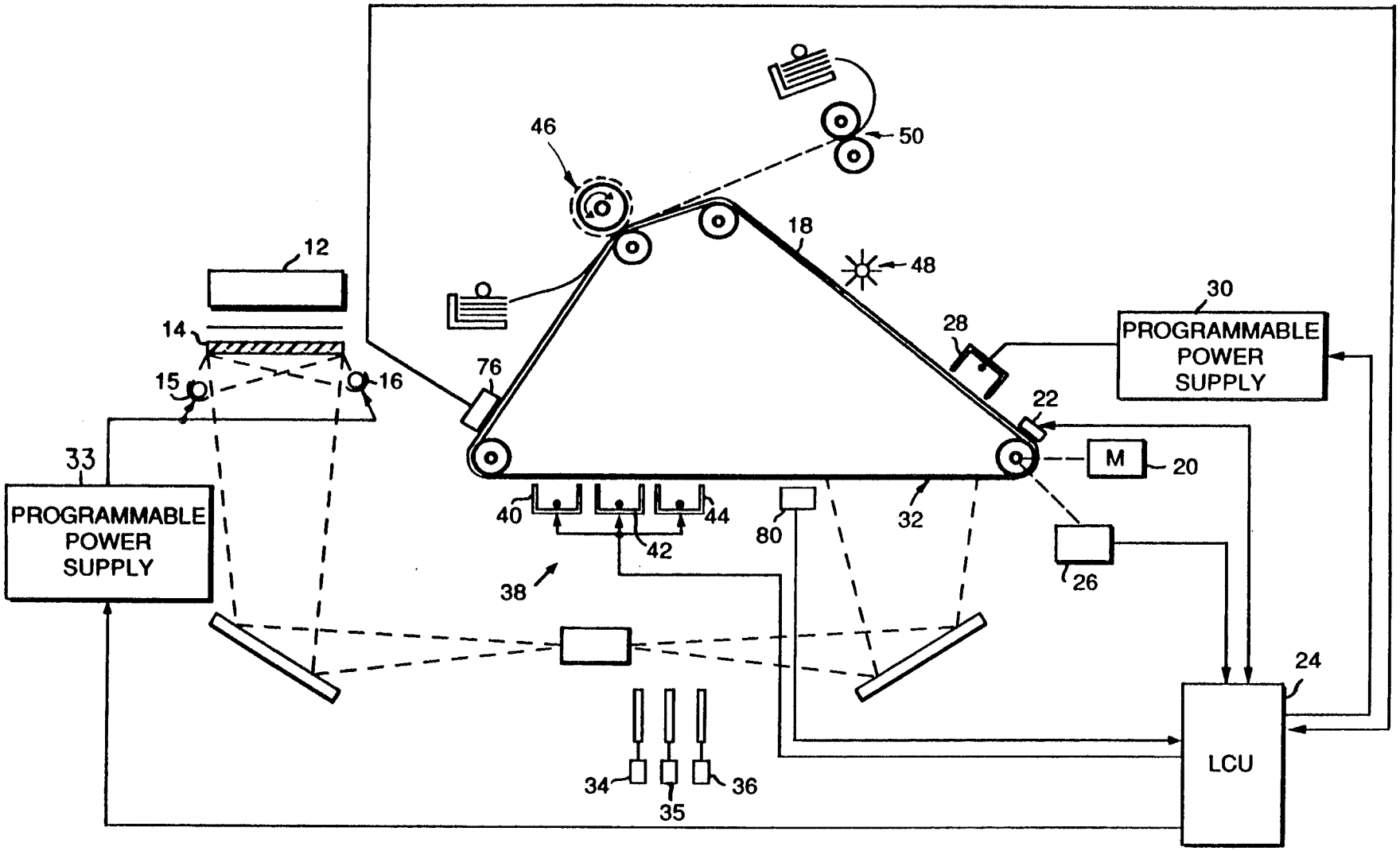
FIG. 1 is a schematic showing a side elevational view of an electrostatographic machine in which the invention is useful.
Figure 2:
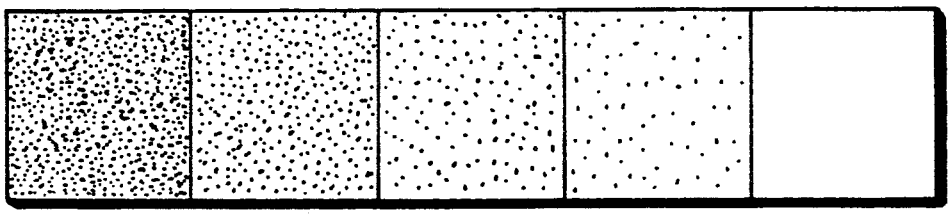
FIG. 2 is an illustration of a neutral density step tablet.

Referring to FIG. 1, a three-color copier includes a recirculating feeder 12 positioned on top of an exposure platen 14 and xenon flashlamps 15 and 16. An image of the illuminated original is optically projected onto one of a plurality of sequentially spaced, non-overlapping image areas of a moving image receiver such as photoconductive belt 18.

Photoconductive belt 18 is driven by a motor 20 past a series of work stations of the copier. A microprocessor within a logic and control unit 24 has a stored program responsive to signals from a generator 22 and an encoder 26 for sequentially actuating the work stations.

For a complete description of the work stations, see commonly assigned U.S. Pat. No. 3,914,046. Briefly, a charging station 28 applies an electrostatic charge of predetermined initial voltage $V_O$ to the surface of the belt as controlled by a programmable power supply 30, which is in turn controlled by LCU 24.

The inverse image of the original is projected onto the charged surface of photoconductive belt 18 at an exposure station 32. The image dissipates the electrostatic charge and forms a latent charge image. A programmable power supply 33, under the supervision of LCU 24, controls the intensity and/or duration of light produced by lamps 15 and 16. This, of course, adjusts the exposure of belt 18, and thereby the voltage of the photoconductor just after exposure. For a specific example of such an exposure station and programmable power supply, see U.S. Pat. No. 4,150,324, issued Aug. 8, 1978.

The illustrated copier is adapted to reproduce three-color copies. The original is illuminated, for example, three times in succession to form three separate latent charge image frames of the original. On successive illuminations, a red filter 34, a green filter 35, or a blue filter 36 is inserted into the light path to form color separation latent charge images at exposure station 32. As understood in the art, provision may be made for a fourth exposure for areas to be developed in black, if desired.

Travel of belt 18 brings the areas bearing the latent charge images into a magnetic brush development area 38. Magnetic brush development stations are well known; for example, see U.S. Pat. Nos. 4,473,029 to Fritz et al and 4,546,060 to Miskinis et al. Conductive portions of the development station act as electrodes, and are electrically connected to a variable supply of D.C. potential controlled by LCU 24 for adjusting the development electrode bias voltage.

The copier also includes a transfer station 46 and a cleaning station 48, both fully described in commonly assigned U.S. patent application Ser. No. 809,546, filed Dec. 16, 1985. After transfer of the unfixed toner images to a copy sheet, such sheet is transported to a fuser station 50 where the image is fixed to the sheet.

A densitometer 76 is provided to monitor development of test patches at predetermined positions within image frame areas of photoconductive belt 18. The densitometer may consist of an infrared light emitting diode (LED) which shines through the belt (transmittance) or is reflected by the belt (reflectance) onto a photodiode. The photodiode generates a voltage proportional to the amount of light transmitted or reflected from a toned patch.

Density aim values for subsequent use in automatic set-up procedures may be programmed into the logic and control unit during manufacture. However, since density aim values corresponding to a good print may need to be slightly different from machine to machine, and according to customer preferences, and since the aim values may have to be updated as the machine ages, determination of a new set of density aim values are best effected in the field.

Figure 3:
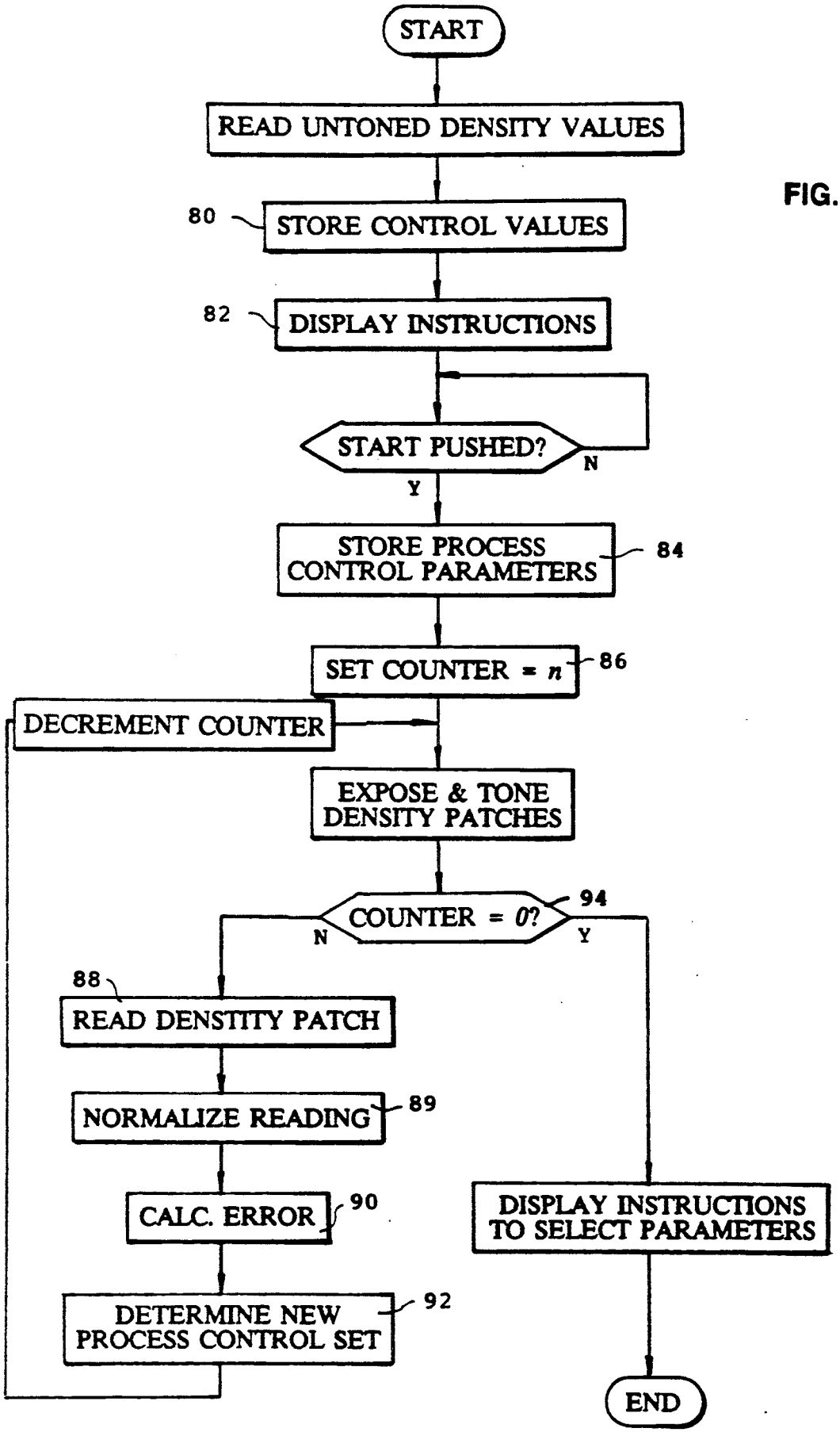
FIG. 3 is a logic flow chart of the operation of the set-up procedure according to the present invention.

To determine a new set of density aim values, a skilled user such as a key operator or service representative manually adjusts the machine for optimal copy quality. Once the adjustment is made, a control density reading of the untoned photoconductive belt is taken by densitometer 76 at, say, five predetermined positions within the image area of each color separation frame, and the readings are stored. Now, a special target document is placed on platen 14. The target document has a plurality (five in this example) of gray scale patches to form a neutral density step tablet such as shown in FIG. 3. The target document is imaged onto the three color separation frames of photoconductive belt 18, with each of the gray scale patches being projected onto one of the predetermined positions from which control density readings were obtained. After exposure, each frame is developed with a different color toner, and the resultant densities are read by densitometer 76. The differences between density readings from each developed gray scale patch and the control density reading from the corresponding area of the untoned photoconductive belt are stored to form a new set of density aim values for subsequent use in an automatic set-up process.

The automatic set-up process uses the special set-up target document described above to compensate for changes in toning by adjusting process control parameters for neutrality and density. Again, the target document has a five-patch gray scale.

Referring to FIG. 3, when the automatic set-up procedure is invoked, a control reading is taken by densitometer 76 during cycle-up. The readings are of the same areas of the untoned photoconductor belt which received exposure of the gray scale patches during the above-described process for determining the density aim values. These control readings are stored (step 80). Now, the operator will be prompted to put the special set-up target document on the platen and to push the START button (step 82). Pressing START will cause the machine to store the original set of process control parameters (step 84) and run the procedure automatically, stopping after "n" iterations set at step 86. The number of iterations generally needed for a particular machine will depend on the accuracy required and the accuracy of a single iteration.

During the first iteration, the target document is imaged onto each of three color separation frames of photoconductive belt 18 in the track of on-line densitometer 76. Each frame is toned with a different color toner, and the resultant densities are read (step 88). The difference between the measured densities and the associated control reading of the same predetermined positions of the untoned image member (determined at step 89) are compared to the set of density aim values stored during the calibration procedure (step 90). Detectable errors between the density values attained and the aim values are used to determine a new set of process control parameters (Step 92). The process is repeated "n" times with the objective of having the last print fall within density tolerances.

By using the difference between the measured densities and the associated control reading of the same areas of the untoned image member taken during cycle-up, automatic correction will be made for non-uniformities in the amount of wear and scumming from one part of the image receiver to another, and for variations in the various coatings applied to the image receiver during manufacture.

The invention has been described in detail with particular reference to preferred embodiments thereof, but it will be understood that variations and modifications can be effected within the spirit and scope of the invention.

What is claimed is:

1. An automatic set-up process for adjusting process control parameters of an electrostatographic machine having an image receiver, said process comprising:

calibrating the machine by:

manually adjusting process control parameters to attain a visually desirable image, detecting the optical density of the untoned image receiver at a predetermined position of the image receiver, recording a toner test patch at said predetermined position according to the manually-adjusted process control parameters, and determining an aim value by normalizing the recorded toner test patch density by said detected optical density of the untoned image receiver at said predetermined position; and setting-up the machine by:

producing a set-up control density reading for said predetermined position by sensing the untoned density of the image receiver at said predetermined position, recording a set-up toner density patch corresponding to the aim value at said predetermined position;

detecting the density of the recorded set-up toner density patches, and setting process control parameters in accordance with differences between the detected density of the recorded set-up toner density patch, normalized by the set-up control density reading, and the aim value.

2. An automatic set-up process for adjusting color process control parameters of an electrostatographic machine having an image receiver, said process comprising:

calibrating the machine by:

manually adjusting process control parameters to attain a visually desirable image, detecting the optical density of the untoned image receiver at a predetermined position of three color separation frames of the image receiver, recording a color separation toner test patch at each of said predetermined positions according to the manually-adjusted process control parameters, and determining an aim value for each color separation toner test patch by normalizing the recorded toner test patch density by said detected optical density of the untoned image receiver at the respective predetermined position; and setting-up the machine by:

producing a set-up control density reading for each of said predetermined positions by sensing the untoned density of the image receiver at said predetermined position of each of said color separation frames, recording a set-up color separation toner density patch corresponding to each aim value at said predetermined positions;

detecting the densities of the recorded set-up toner density patches, and setting process control parameters in accordance with differences between the detected densities of the recorded set-up toner density patches, normalized by the respective set-up control density reading, and the aim values.

3. An automatic set-up process for adjusting color process control parameters of an electrostatographic machine as defined in claim 2 wherein said calibrating and setting-up steps are conducted on a plurality of positions in each color separation frame, and the test patches in each of the plurality of positions has a unique density.

4. An electrostatographic machine having automatic set-up apparatus for adjusting process control parameters, said machine comprising:

an image receiver having image frame areas;

means for storing a density aim value corresponding to a desired density patch reading at at least one predetermined position within at least one of the image frame areas;

means for producing a control density reading for said predetermined position by sensing the untoned density of the image receiver at said predetermined position;

means for recording a set-up toner density patch corresponding to the stored density aim value at said predetermined position;

means for detecting the density of the recorded set-up toner density patch; and means for setting process control parameters in accordance with the difference between the density of the recorded patch, normalized by the corresponding control density reading, and the corresponding aim value.

5. An electrostatographic machine having automatic set-up apparatus for adjusting process control parameters, said machine comprising:

an image receiver having image frame areas;

means for storing a set of density aim values corresponding to desired density patch readings at predetermined positions within at least one image frame area;

means for producing a control density reading for each of said predetermined positions by sensing the untoned density of the image receiver at said predetermined positions;

means for recording a series of set-up toner density patches corresponding to the stored set of density aim values at said predetermined positions;

means for detecting the density of the recorded set-up toner density patches; and means for setting process control parameters in accordance with differences between the densities of the recorded patches, normalized by the corresponding control density reading, and the corresponding aim values.

6. A color electrostatographic machine having automatic set-up apparatus for adjusting process control parameters, said machine comprising:

an image receiver having color separation image frame areas;

means for storing a density aim value corresponding to a desired density patch reading at at least one predetermined position within the image area of each of a plurality of said color separation frame areas;

means for producing a control density reading for each of said predetermined positions by sensing the untoned density of the image receiver at said predetermined positions;

means for recording a series of set-up toner density patches corresponding to the stored density aim values at said predetermined positions;

means for detecting the density of the recorded set-up toner density patches; and means for setting process control parameters in accordance with differences between the densities of the recorded patches, normalized by the corresponding control density reading, and the corresponding aim values.

* * * * *